US005791164A

United States Patent [19]

Carroll et al.

[11] Patent Number: 5,791,164

[45] Date of Patent: *Aug. 11, 1998

[54] OUTDOOR SPORTING FABRIC

[75] Inventors: Patrick R. Carroll; Robert D. Miller, both of Simpsonville, S.C.

[73] Assignee: Milliken Research Corporation, Spartanburg, S.C.

[ * ] Notice: This patent issued on a continued prosecution application filed under 37 CFR 1.53(d), and is subject to the twenty year patent term provisions of 35 U.S.C. 154(a)(2).

[21] Appl. No.: 664,589

[22] Filed: Jun. 17, 1996

[51] Int. Cl.[6] ..... D04B 21/04

[52] U.S. Cl. ..... 66/194; 66/195

[58] Field of Search ..... 66/194, 195; 2/93

[56] References Cited

U.S. PATENT DOCUMENTS

| | | | |
|---|---|---|---|
| 3,475,926 | 11/1969 | Ruckstuhl | 66/195 X |
| 4,546,026 | 10/1985 | Kowalski | 28/162 X |
| 4,567,075 | 1/1986 | Krawczyk | 28/162 X |
| 4,712,281 | 12/1987 | Scheller | 28/162 |
| 5,364,678 | 11/1994 | Lumb et al. | 2/93 X |
| 5,461,884 | 10/1995 | Depoe et al. | 66/195 X |
| 5,465,467 | 11/1995 | Fan | 28/162 X |

FOREIGN PATENT DOCUMENTS

| | | | |
|---|---|---|---|
| 0007741 | 2/1985 | Japan | 66/195 |
| 6802502 | 8/1968 | Netherlands | 66/195 |

OTHER PUBLICATIONS

Research Disclosure No. 17749, Anonymous, p. 22, Jan. 1979.

*Primary Examiner*—John J. Calvert

*Attorney, Agent, or Firm*—Terry T. Moyer; James M. Robertson

[57] ABSTRACT

The present invention provides a knit fabric and outdoor sporting apparel formed therefrom. The fabric includes a base structure of polyester yarn and a multiplicity of nylon pile yarns knitted into and extending from the base structure. The fabric exhibits excellent resistance to abrasion, snagging and burr accumulation while muffling scratching noise emissions as it is conveyed through a natural growth environment.

9 Claims, 2 Drawing Sheets

OUTDOOR SPORTING FABRIC

FIELD OF TEE INVENTION

The present invention relates generally to fabric for use in garments worn during outdoor sporting activities and more particularly to a fabric possessing a soft fleece-like surface with superior abrasion resistance and which resists accumulating burrs, thistles, thorns, and other naturally occurring debris.

BACKGROUND

Fabrics which are worn during outdoor activities such as nature photography, hunting, birdwatching, and the like should possess a number of performance characteristics in order to be fully effective. A useful fabric will preferably have good resistance to abrasion so as not to be unduly susceptible to damage by scratches which may be imparted by limbs and underbrush as the wearer moves through a covered area. It is likewise desirable that a fabric possess a low susceptibility for attraction and retention of burrs, thistles, twigs and other debris which tends to adhere to a wearer's clothing. Such adherence will be generally referred to herein as "burr accumulation".

As will be appreciated, the desirable features of abrasion resistance and reduced burr accumulation can be generally achieved by providing a fabric having a relatively smooth tightly constructed outer surface of a material such as polypropylene or the like. As will be further recognized, however, such smooth tightly constructed materials have a relatively stiff outer surface which tends to magnify sound emissions as it is scrapped by limbs, underbrush or other objects with which it may come in contact during the wearer's outdoor activity. In addition in order to obtain a fairly smooth surface, such outdoor wear or "shell" fabrics are generally formed from polymeric materials in a substantially flat structure which tends to emit a reflection or shine when exposed to sunlight.

In the performance of a number of outdoor activities, it is desirable to reduce or eliminate, the noise emissions which result from scrapping actions and to minimize the shine produced by the fabric in sunlight. The achievement of these goals is of particular benefit when the fabric is to be used in articles of clothing worn during outdoor activities involving interaction with wildlife which may be frightened away by either an undue level of noise or an unnatural reflection from a garment. At the same time, it is undesirable to sacrifice the benefits of abrasion resistance and reduced burr accumulation which relate to the durability of the garment and comfort of the wearer. While noise reduction as heretofore been available through the use of natural fleeced fabrics which tend to absorb energy and thereby muffle scrapping noises, such fabrics typically exhibit a high degree of burr accumulation and further tend to snag on brush thereby giving rise to noise generated as branches and twigs break off thereby greatly negating any benefit gained from the reduction in scratching noise emissions.

The present invention provides a fabric which is useful in articles of outdoor apparel including, by way of example and not limitation, caps, camouflage masks, jackets, vests, gloves, leggings, and footwear linings and outer surfaces which exhibit a substantial reduction in scratching noise emission through use of a raised piling surface to muffle such noise while nonetheless preventing burr accumulation. Accordingly, the present invention provides a useful advancement over the prior art.

OBJECTS AND SUMMARY OF THE INVENTION

In light of the foregoing, it is a general object of the present invention to provide a fabric and garments produced therefrom exhibiting a low level of noise emission when subjected to a scrapping environment while preventing substantial burr accumulation or the emission of high shine characteristics.

In that respect, it is an object of the present invention to provide an outdoor sporting fabric possessing a raised pile surface for aesthetics and reduced noise emissions.

It is a further object of the present invention to provide a fabric construction which has minimal burr retention characteristics.

It is an additional object of the present invention to provide a fabric construction which does not emit a high level of reflective shine when exposed to sunlight.

Accordingly, it is a feature of the present invention to provide a knit fabric and garments formed therefrom incorporating a polyester ground yarn or base structure and a raised nylon pile extending therefrom.

It is a subsidiary feature of the present invention to provide a warp knit fabric construction and garments formed therefrom including a base structure of polyester yarn knitted with nylon yarns exposed on the surface of the base structure and raised in a pile structure by means of sanding or napping.

It is yet a further subsidiary feature of the present invention to provide a water repellant knit fabric comprising a base structure of polyester yarn and a plurality of nylon yarns extending therefrom.

In one aspect of the present invention, a warp knit fabric and outdoor sporting apparel formed therefrom are provided. The fabric comprises a base structure of polyester yarn and a plurality of nylon pile yams knitted into and extending from the base structure. The nylon pile yarns are preferably raised from the base structure by means of sanding, brushing, or other treatment to form a fleece-like surface. The fabric has excellent resistance to abrasion, snagging, and burr accumulation such that noise emissions are reduced in comparison to non-fleece shell fabrics and burr accumulation is reduced in comparison to natural fleece surfaces when the fabric is conveyed by a wearer through an undergrowth environment.

Other objects, features, and advantages of the invention will become apparent upon reading the following detailed description and upon reference to the drawings provided herein.

While the invention will be described in connection with the potentially preferred embodiment, it is to be understood that we in no way intend to limit the invention to that embodiment. On the contrary, it is intended to cover all alternatives, modifications, and equivalents as may be included within the spirit and scope of the invention as defined by the appended claims and equivalents thereto.

DESCRIPTION

Figure 1:
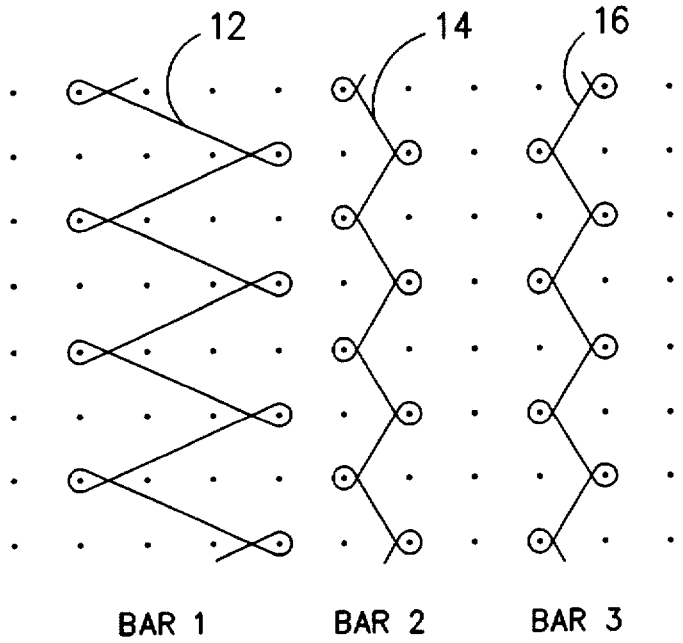
FIG. 1 is a needle point diagram illustrating a potentially preferred three-bar warp knit construction for the fabric of the present invention.
Figure 2:
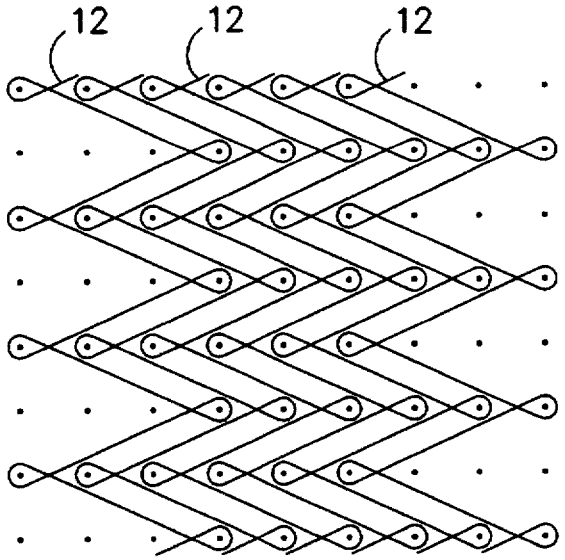
FIG. 2 is a needle point diagram illustrating a potentially preferred repeat pattern for the yarn of Bar 1 from FIG. 1.

Turning now to the drawings, wherein like reference numerals designate like elements in the various views, in FIG. 1 there is shown a needle point diagram illustrating a potentially preferred three-bar warp knit pattern for the fabric of the present invention. In the illustrated and potentially preferred embodiment, the yarn 12 of Bar 1 is a multifilament nylon yarn while the yarns 14, 16 of Bars 2 and 3 are monofilament polyester yarns. In the potentially preferred embodiment each bar is fully threaded such that the yarns repeat without interruption in an overlapping configuration across the width of the fabric as it is formed. The pattern for the yarn of Bar 1 is illustrated in FIG. 2. In the potentially preferred configuration, the yarn 12 of Bar 1 is a nylon yarn having a linear density of about 70 denier. In a particularly preferred embodiment, such nylon yarn is a 70 denier multifilament yarn with 34 filaments per yarn available from DuPont de Nemours having a place of business in Wilmington, Del. It is believed that such yarn is available under the trade designation T-865 SD ANTRON®.

Figure 3:
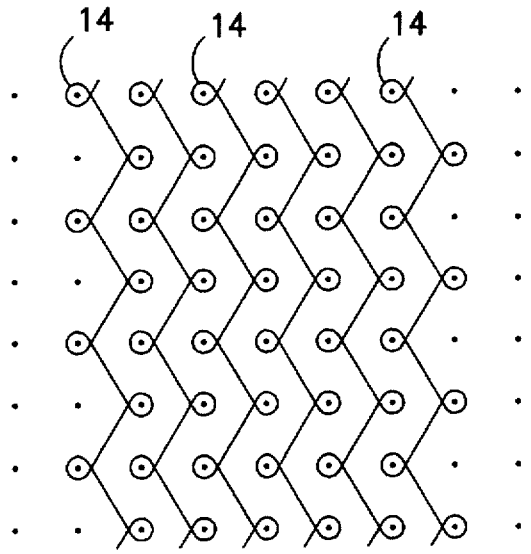
FIG. 3 is a needle point diagram illustrating a potentially preferred repeat pattern for the yarn of Bar 2 from FIG. 1.
Figure 4:
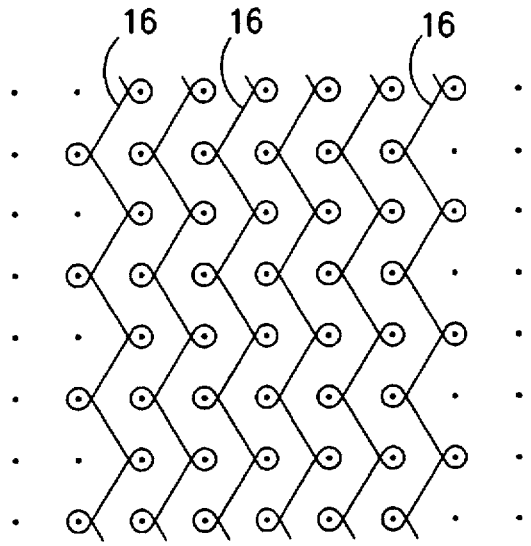
FIG. 4 is a needle point diagram illustrating a potentially preferred repeat pattern for the yarn of Bar 3 from FIG. 1.

The patterns for the yarn of Bars 2 and 3 are illustrated in FIGS. 3 and 4 respectively. In. the potentially preferred embodiment of the present invention, the yarns of Bars 2 and 3 are substantially similar monofilament polyester yarns each having a linear density of about 20. Such yarns are believed to be available from Warp Technologies having a place of business in Cary, N.C.

In the potentially preferred embodiment, the fabric of th e present invention is a two-layer warp knit fabric having a first layer formed from raised multifilament nylon yarns 12 and a second layer serving as a base layer formed from the monofilament polyester yarns 14, 16 as described above. The first fabric layer and the second fabric layer are preferably formed concurrently by knitting in a warp knit construction according to the patterns as shown in FIGS. 2–4 so that the layers are distinct while yarns of the layers are nonetheless integrated with one another. In a significant aspect of the present invention, the first layer of the fabric preferably formed by the nylon yarn of bar 1 is raised by a process such as napping, sanding or brushing such as are well know to those of skill in the art so as to form a pile extending from yet integrated with the second fabric layer which is preferably formed by the polyester yarns of bars 2 and 3.

As will be recognized, by raising the multifilament nylon pile yarns from a base structure of monofilament polyester, a fabric having a fleece-like surface formed by individual nylon filaments with a stable base of monofilament polyester is provided. It has been found that by incorporating this fabric into articles of clothing wherein the fleece surface is used as the exterior or outerwear surface that articles having extremely low noise emission characteristics when subjected to scrapping environments are obtained. This low noise emission is believed to be due to the energy absorption provided by the pile. Moreover, the raised nylon pile does not tend to attract or retain naturally occurring debris such as leaves and burrs when conveyed through a natural growth environment. Finally, due to the integrated stable construction of the fabric configuration, the garments are not susceptible to undue abrasion damage from thorns, branches and the like during use. Moreover, the same pile characteristics which tend to dampen noise emissions also tend to impart a soft and desirable feel to the surface of the fabric while at the same time reducing the rigidity thereof.

It has also been found that the fabric of the present invention may be made water repellant through the application of hydrophobic chemical compositions. One such preferred composition is available under the trademark SCOTCHGUARD® which is believed to be available from 3M Company having a place of business in St. Paul, Minn. In order to further illustrate the composite fabric of the invention, the following example is provided.

EXAMPLE

A composite fabric formed in accordance with the present invention was knit on a warp knitting machine in a fall thread three-bar knit structure according to the pattern as illustrated in FIG. 1. The yarn of Bar 1 was nylon 6.6 having a linear density of 70 denier with 34 filaments per yarn. The yarns of Bars 2 and 3 were monofilament polyester having a linear density of 20 denier. In the fabric construction, the nylon yarn made up approximately 78 weight percent of the fabric with the polyester monofilament making up the remaining 22 weight percent.

The greige fabric had a width of 95.7 inches with 50 courses per inch and 28 wales per inch. The fabric was thereafter finished by sanding on a Curtin Herbert Sander or Sueder. After sanding, the fabric was dyed by means of dye jet practices as are well known and thereafter dried and heatset on a Monfort tenter at a temperature of about 380° F. at a speed of about 25 yards pier minute and dwell time of about 45 seconds.

The finished fabric had a width of 64 inches with 64 courses per inch and 41 wales per inch.

As can be seen, the present invention provides a fabric construction and garments formed therefrom particularly useful in the performance of outdoor activities wherein noise emissions are to be minimized and burr accumulation is to be prevented. Moreover, this fabric possesses the desirable qualities of lightweight and desirable softness. While specific embodiments of the invention have been shown and described, it will be understood, of course, that the invention is not limited thereto, since modifications may be made and other embodiments of the principals of this invention will occur to those skilled in the art to which the invention pertains. Therefore, it is contemplated by the appended claims to cover any such modifications and other embodiments as incorporate the features of this invention within the true spirit and scope of such claims.

What is claimed is:

1. A knit fabric for use in outdoor sporting apparel, the fabric comprising: a base structure of polyester yarns and a plurality of multifilament nylon pile yarns knitted into said base structure in integrated stable relation to said base structure by loop forming engage with said polyester yarns such that said multifilament nylon pile yarns are tied to, said polyester yarns and form a distinct surface across said base structure, said nylon pile yarns being raised from said base structure such that individual pile filaments extend from said base structure to form a fleece-like surface of nylon which muffles scraping noise emissions and exhibits reduced burr accumulation in comparison to natural fleece surfaces when worn by a wearer through an undergrowth environment.

2. The fabric as in claim 1, wherein said polyester yarn is a monofilament yarn.

3. The fabric as in claim 2, wherein said polyester yarn has a denier of about 20.

4. The fabric as in claim 1, wherein said multifilament nylon pile yarns have a denier of about 70.

5. The fabric as in claim 1, wherein said knit fabric is a warp knit fabric.

6. The fabric as in claim 1, further comprising a water repelling agent on said nylon pile yarns.

7. A garment formed from the fabric of claim 1.

8. The fabric as in claim 1, wherein said polyester yarns are monofilament yarns having a denier of about 20 and said multifilament nylon yarns have a denier of about 70.

9. A garment formed from the fabric of claim 8.

* * * * *